US005918382A

United States Patent [19]

Haderlein et al.

[11] Patent Number: 5,918,382

[45] Date of Patent: Jul. 6, 1999

[54] WATERPROOF SHOE WITH AN INSOLE AND A LINING SOLE

[75] Inventors: Manfred Haderlein, Haan; Liviu-Mihai Pavelescu, Wuppertal, both of Germany

[73] Assignee: Akzo Nobel NV, Arnhem, Netherlands

[21] Appl. No.: 08/984,180

[22] Filed: Dec. 3, 1997

[30] Foreign Application Priority Data

Mar. 7, 1997 [DE] Germany ..... 197 09 365

[51] Int. Cl.[6] ..... A43B 23/07

[52] U.S. Cl. ..... 36/14; 36/55

[58] Field of Search ..... 36/14, 12, 55, 36/30 A

[56] References Cited

U.S. PATENT DOCUMENTS

| | | |
|---|---|---|
| Re. 34,890 | 4/1995 | Sacre . |
| 3,028,690 | 4/1962 | Bailey . |
| 3,029,823 | 4/1962 | Zerkowitz . |
| 5,289,644 | 3/1994 | Driskill et al. . |
| 5,659,914 | 8/1997 | Steinlauf . |
| 5,678,326 | 10/1997 | Pavelescu . |

FOREIGN PATENT DOCUMENTS

| | | |
|---|---|---|
| 0 080 710 A2 | 6/1983 | European Pat. Off. . |
| 195 13 413 C1 | 3/1997 | Germany . |
| WO96/41549 | 12/1996 | WIPO . |
| WO97/24940 | 7/1997 | WIPO . |

*Primary Examiner*—Ted Kavanaugh
*Attorney, Agent, or Firm*—Oliff & Berridge, PLC

[57] ABSTRACT

A waterproof shoe structure, which includes an outer layer, a lining with a waterproof but water-vapor permeable functional layer, a lining sole, an insole and an outsole. The lining which contains the functional layer has a lower end area which is turned back to the inside and positioned parallel to the outsole. The shoe structure includes: the lower end area of the lining which is turned back lying at the same level as the lining sole, the outer edge of the lining sole at least approximately parallel to and connected to the inner border of the lower end area of the lining which is turned back, the insole bonded from below in a waterproof manner to the functional layer in the lower end area of the lining which is turned back, and the insole waterproofed at least on its surface which faces towards the inside of the shoe structure.

13 Claims, 1 Drawing Sheet

WATERPROOF SHOE WITH AN INSOLE AND A LINING SOLE

BACKGROUND OF THE INVENTION

1. Field of Invention

The invention relates to a waterproof shoe structure, which comprises at least part of a shoe and includes an outer layer, a lining with a waterproof but water-vapor permeable functional layer, a lining sole, an insole and an outsole.

2. Description of Related Art

Shoes with a shoe structure which includes a lining fitted with a waterproof and water-vapor permeable functional layer are widely known, as is their high degree of wearing comfort. Constructing shoes of this kind in a watertight manner is always problematic when the shoe includes seams, e.g. those used to attach the lining. Water can be drawn in through seam lines of this kind by capillary action and is able to penetrate to the inner area of the shoe. In the most simple embodiment, the functional layer is inserted in the form of a sock (which has become well known as a 'booty', see EP-0 080 710 A2), which is only connected to the outer layer at the top opening of the shoe. In this embodiment, the lining which contains a functional layer is also present in the sole area of the shoe, which is often unnecessary, since the outsole itself is usually not water-vapor permeable. Moreover, the time and expense involved in constructing the lining in the form of a sock is often too high for many applications.

Consequently, the shoe structure described in WO 96/41549, which is not constructed as an embodiment with a sock, is an improvement. In that case, an insole is used in addition to the lining which contains a functional layer. The lower end area of the lining is turned back to the inside in the sole area and positioned approximately parallel to the outsole. In this end area and at the extreme edge of the lining, the functional layer is bonded to the synthetic material of the sole in a waterproof manner, which guarantees that the shoe is watertight.

WO 97/24940 describes a waterproof shoe structure with an insole and a bonded outsole. In this shoe structure too, the lower end area of the lining is turned back to the inside in the sole area and positioned approximately parallel to the sole. The end area which is turned back and the insole lie at the same level and are connected to each other. The watertightness of the shoe is achieved by bonding the surface of the outsole at least to the end area of the functional layer of the lining which is turned back.

In order to guarantee on production that the shape of the shoe structure is maintained, pieces of netting produced from monofilaments are used in both the cases mentioned; these pieces of netting are positioned parallel to the insole and are connected to the lower ends of the outer layer, either at least in the ankle area or across the entire extent of the foot area. Sewing these retainers to the outer layer involves considerable time and expense in the manufacturing process.

SUMMARY OF THE INVENTION

The object of the invention is therefore to make available a further waterproof shoe structure, which can be manufactured more simply and economically.

BRIEF DESCRIPTION OF THE DRAWING

The invention is illustrated in detail in the following figure:

The FIGURE shows a partial section through a shoe structure of the invention.

DETAILED DESCRIPTION OF PREFERRED EMBODIMENTS

Figure 1:
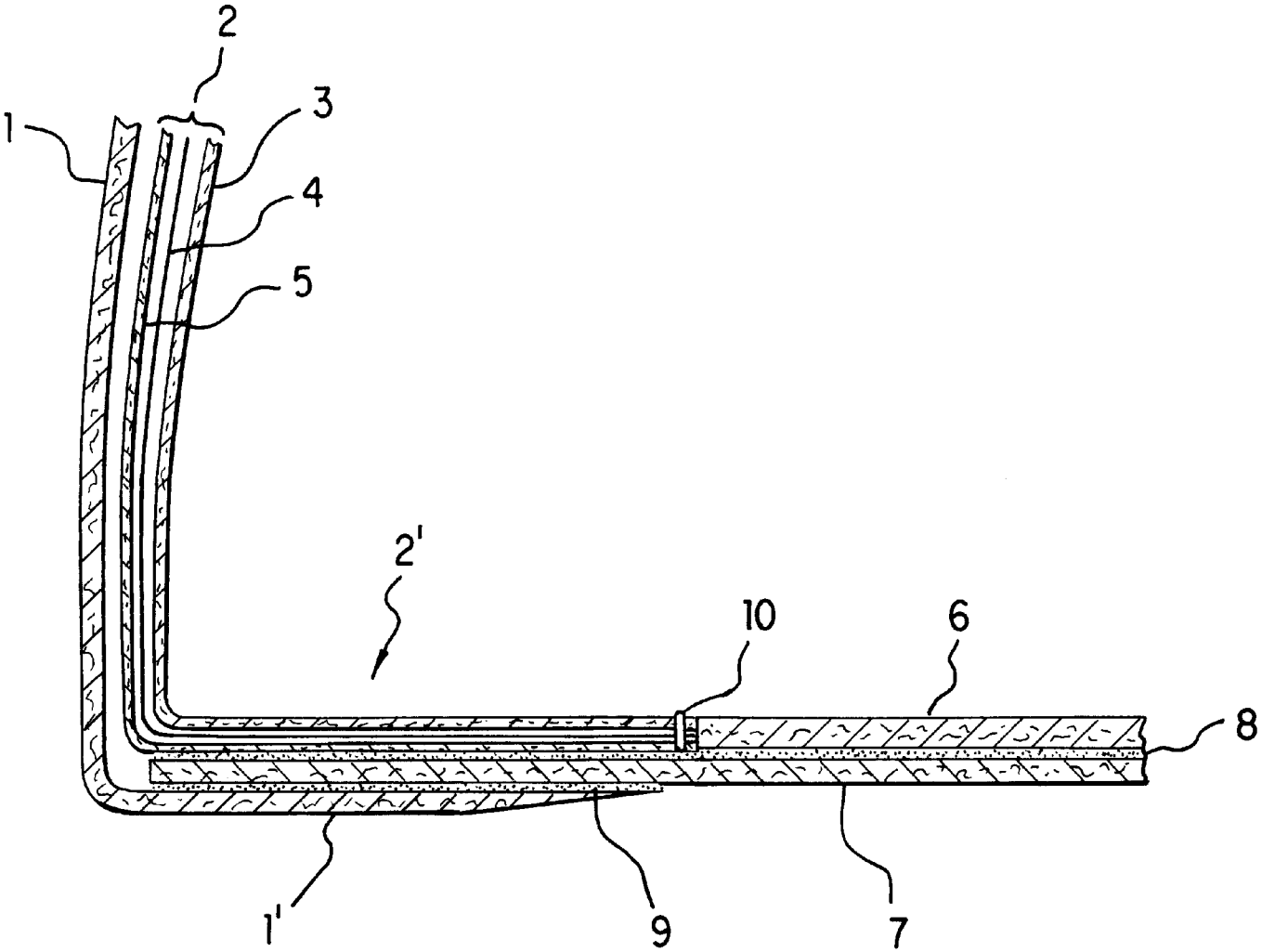

In a shoe structure, which comprises at least part of a shoe and includes an outer layer, a lining with a waterproof but water-vapor permeable functional layer, a lining sole, an insole and an outsole, whereby the lining which contains the functional layer has a lower end area which is turned back to the inside and positioned parallel to the outsole, the problem is solved in accordance with the invention as follows: the end area which is turned back lies at the same level as the lining sole, the outer edge of the lining sole is at least approximately parallel to and connected to the inner border of the end area which is turned back, the insole is bonded from below in a waterproof manner to the functional layer in the lower end area of the lining which is turned back, and the insole is constructed in a waterproof manner, at least on its surface which faces towards the inside of the shoe structure.

The lower end area should lie at the same level as the lining sole, as described. The lower end area of the lining and the lining sole should therefore be positioned so that both the end area and the lining sole lie essentially flat on the insole. This does not preclude the possibility that the lining sole and the lower end area which is turned back may overlap. It is, however, also absolutely acceptable for there to be a space between the lower end area and the lining sole. In this case, the outer edge of the lining sole and the lower end area are preferably sewn together (with a Strobel seam). As the Strobel seam is formed, the space between the above-mentioned elements can be easily bridged with the threads which form the seam. A Strobel seam is one produced on a sewing machine manufactured by Strobel.

The waterproof shoe structure of the invention preferably has a lining which is a laminate, in which a functional layer is connected to the lining. In special cases it can be advantageous for the side of the functional layer which faces away from the lining to be connected to a textile reinforcing layer. A membrane which is marketed under the brand name SYMPATEX has proven extremely successful as a functional layer.

It is essential in the present invention for the insole to be bonded in a waterproof manner to the turned-back lower end area of the lining which contains the functional layer. The insole should also preferably be bonded in a waterproof manner to the lining sole. In bonding in a waterproof manner, a very thin adhesive layer is formed, so that an internal connection is achieved between the insole and the lower end area of the lining and preferably also between the insole and the lining sole. Alternatively, a thicker layer of adhesive can be used, whereby adhesives should then preferably be used which are waterproof when they have hardened. Polyurethane adhesives are ideally suited for this purpose.

The watertightness of the shoe structure is improved if the insole has been waterproofed on its surface which faces towards the inside of the shoe structure, by means of, for example, an impregnation or coating process. Equally successful results are achieved if the surface which faces towards the outside of the shoe structure is waterproofed using methods of this kind, or if the insole is made entirely of a waterproof material.

The lining sole and the insole should preferably be constructed to be flexible. Here, the lining sole should preferably be constructed in the form of a flat textile structure. Also, in particular with a view to increasing the wearing comfort of the shoe, the lining sole should be approximately the same thickness as the end of the lining which is turned back. Nonwovens, felts, knitted fabrics, and in particular woven fabrics are suitable for use as a flat textile structure.

The Figure shows a partial section through a shoe structure of the invention. The upper consists of an outer layer 1, which can, for example, be made of leather or a textile fabric. Positioned inside the outer layer 1 and above the insole is a lining 2 and 2'. The lining 2 and 2' is a laminate made of a waterproof but water-vapor permeable functional layer 4, which is faced, both on the surface which faces the inner area of the shoe and the surface which faces the outside of the shoe, with a layer which is preferably made of a textile fabric such as a knitted, woven or nonwoven fabric, whereby the textile layer 3 on the foot side can take the form of a lining. The textile material 5 which is positioned on the outer side of the shoe generally has a supportive or protective function for the waterproof functional layer. Laminates constructed from three layers of this kind are widely known. There is, for example, a well-known laminate which contains a functional layer marketed under the brand name SYMPATEX.

The lining 2 is turned back to the inside in the sole area in such a manner that the lower end area of the lining which is turned back 2' lies at the same level as the lining sole 6. The outer edge of the lining sole 6 should ideally be sewn with a Strobel seam to the inner border of the end area which is turned back 2' at the seam line 10. The insole 7 is bonded from below in a waterproof manner to the functional layer 4 in the lower end area which is turned back 2' and preferably also to the lining sole 6, by means of the adhesive layer 8, whereby the textile material 5 is penetrated by the adhesive layer 8 in the end area which is turned back 2'.

The waterproof shoe structure of the invention is in practice suitable for use in all shoe constructions and shoe designs and with either a bonded or an injection molded outsole.

The shoe structure of the invention has been used particularly successfully in cement-lasted shoe structures, as illustrated in the Figure. In production of this shoe structure, the outer layer 1 is bonded in its lower end area 1' to the outer border of the underside of the insole 7 of the preconstructed inner part of the shoe structure, by means of an adhesive layer 9. Here, the inner part of the shoe structure is pulled over a last and the adhesive layer 9 allowed to dry partially. The outer layer is then taken hold of with a pair of pliers, bent around the point where the lining 2 and the insole 7 are connected, and pressed firmly into place from below.

Because the insole 7 is bonded into place, the connecting seam 10 between the outer edge of the lower end area of the lining 2' and the lining sole 6 is not only sealed in a waterproof manner, but also stabilized. The latter feature is of prime importance for simplification of the manufacturing process. The tension of the outer layer 1, which may, for example, be made of leather, is not applied at the seam line 10 of the lining sole 6 and the lining 2 in the manufacturing process, but rather at the considerably more stable insole 6. For this reason, it is not necessary to use a netting made of filaments for shape retention in production of the shoe structure of the invention. This allows for a more simple and economical manufacturing process. In this respect, the shoe structure of the invention is particularly suitable for use in cement-lasted embodiments.

What is claimed is:

1. A waterproof shoe structure, which comprises at least part of a shoe, comprising an outer layer, a lining having a waterproof but water-vapor permeable functional layer, a lining sole, an insole and an outsole, wherein the lining which contains the functional layer has a lower end area which is turned back to an inside of the shoe structure and positioned parallel to the outsole, wherein the lower end area which is turned back lies at the same level as the lining sole, wherein an outer edge of the lining sole is at least approximately parallel to the lower end area which is turned back and is connected to an inner border of the lower end area which is turned back, wherein a waterproof bond is formed between the functional layer in the lower end area of the lining which is turned back and the insole positioned beneath the functional layer, and wherein the insole is waterproofed at least on a surface which faces towards the inside of the shoe structure.

2. A waterproof shoe structure in accordance with claim 1, wherein a waterproof bond is formed between the lining sole and the insole positioned beneath the lining sole.

3. A waterproof shoe structure in accordance with claim 1, wherein at least one surface of the insole is waterproofed by an impregnation process.

4. A waterproof shoe structure in accordance with claim 1, wherein the insole is a waterproof material.

5. A waterproof shoe structure in accordance with claim 1, wherein the lining sole is flexible.

6. A waterproof shoe structure in accordance with claim 1, wherein the insole is flexible.

7. A waterproof shoe structure in accordance with claim 1, wherein the lining sole is a flat textile structure.

8. A waterproof shoe structure in accordance with claim 1, wherein the lining sole is at least approximately the same thickness as the lower end area of the lining which is turned back.

9. A waterproof shoe structure in accordance with claim 1, wherein the outer edge of the lining sole is sewn with a Strobel seam to the inner border of the lower end area which is turned back.

10. A waterproof shoe structure in accordance with claim 1, wherein the waterproof bond is formed with an adhesive.

11. A waterproof shoe structure in accordance with claim 10, wherein the adhesive is a polyurethane adhesive.

12. A waterproof shoe structure in accordance with claim 1, wherein at least one surface of the insole is waterproofed by a coating process.

13. A waterproof shoe structure in accordance with claim 1, wherein a bottom surface of the lower end area of the lining which is turned back lies at the same level as a bottom surface of the lining sole.

* * * * *